US008915749B2

(12) United States Patent
Ikeda et al.

(10) Patent No.: US 8,915,749 B2
(45) Date of Patent: Dec. 23, 2014

(54) POWER SOURCE CIRCUIT SHUTOFF DEVICE

(71) Applicant: Yazaki Corporation, Tokyo (JP)

(72) Inventors: Tomohiro Ikeda, Kakegawa (JP); Ryuta Takishita, Kakegawa (JP); Kouichiro Mochizuki, Kakegawa (JP); Fumitoshi Henmi, Kakegawa (JP); Teruhiko Ohike, Kakegawa (JP); Sho Nogashira, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/850,638

(22) Filed: Mar. 26, 2013

(65) Prior Publication Data

US 2013/0206559 A1 Aug. 15, 2013

Related U.S. Application Data

(63) Continuation of application No. 13/610,278, filed on Sep. 11, 2012, now abandoned.

(30) Foreign Application Priority Data

Sep. 12, 2011 (JP) ..... 2011-198108

(51) Int. Cl.

| | |
|---|---|
| ***H01R 13/62*** | (2006.01) |
| ***H01R 13/629*** | (2006.01) |
| ***H01H 3/06*** | (2006.01) |
| ***H01R 13/703*** | (2006.01) |

(52) U.S. Cl.

CPC ..... *H01H 3/06* (2013.01); *H01R 13/62938* (2013.01); *H01R 13/703* (2013.01); *H01R 2201/26* (2013.01)

USPC ..... 439/157; 439/372

(58) Field of Classification Search

CPC ..... H01R 13/629; H01R 13/62933; H01R 13/62938; H01R 13/6295; H01R 13/62955; H01R 13/639; H01R 13/64; H01R 43/26

USPC ..... 439/157, 372

See application file for complete search history.

(56) References Cited

U.S. PATENT DOCUMENTS

| | | | | |
|---|---|---|---|---|
| 6,413,105 | B2 * | 7/2002 | Noro et al. | 439/157 |
| 6,558,176 | B1 * | 5/2003 | Martin et al. | 439/157 |

(Continued)

FOREIGN PATENT DOCUMENTS

| | | | |
|---|---|---|---|
| DE | 697 08 827 | T2 | 6/2002 |
| JP | 2002-110300 | A | 4/2002 |
| JP | 2009-181895 | A | 8/2009 |

OTHER PUBLICATIONS

Chinese Office Action issued May 28, 2014 in a corresponding Chinese Patent Application No. 201210335740.1.

(Continued)

*Primary Examiner* — Thanh Tam Le

(74) *Attorney, Agent, or Firm* — Sughrue Mion, PLLC

(57) ABSTRACT

A power source circuit shutoff device includes: a base housing including a first mating wall and a cam pin; a lever housing including a second mating wall; and an operation lever rotatably supported to the lever housing and having a cam groove for guiding the cam pin. The base housing and the lever housing are set to a lever mating start position in which the first mating wall and the second mating wall are partly overlapped with each other and the cam pin is entered into the cam groove of the operation lever, and a rotation of the operation lever moves the cam pin in the cam groove to thereby cause a mating force between the first mating wall and the second mating wall. The base housing and the lever housing respectively have restriction ribs.

5 Claims, 10 Drawing Sheets

(56) References Cited

U.S. PATENT DOCUMENTS

| | | | | |
|---|---|---|---|---|
| 6,808,429 | B2 * | 10/2004 | Takada et al. | 439/752 |
| 6,837,753 | B2 * | 1/2005 | Shinozaki et al. | 439/752 |
| 6,942,504 | B2 * | 9/2005 | Shinozaki et al. | 439/157 |
| 7,063,548 | B2 * | 6/2006 | Ohara | 439/157 |
| 7,258,557 | B2 * | 8/2007 | Matsubara et al. | 439/157 |
| 7,270,553 | B2 * | 9/2007 | Matsubara et al. | 439/157 |
| 7,384,286 | B2 * | 6/2008 | Imai et al. | 439/157 |
| 7,520,765 | B2 * | 4/2009 | Fukatsu et al. | 439/157 |
| 7,628,639 | B2 * | 12/2009 | Matsumura et al. | 439/372 |
| 7,749,004 | B2 * | 7/2010 | Shuey | 439/157 |
| 2006/0084304 | A1 | 4/2006 | Ohara | |
| 2009/0163062 | A1 | 6/2009 | Matsumura et al. | |
| 2009/0197456 | A1 | 8/2009 | Kawai et al. | |
| 2009/0246992 | A1 | 10/2009 | Martin | |
| 2009/0286430 | A1 | 11/2009 | Van Den Meersschaut et al. | |

OTHER PUBLICATIONS

Communication from the German Patent and Trademark Office issued Sep. 15, 2014 in a counterpart German Application No. 10 2012 216 060.4.

* cited by examiner

POWER SOURCE CIRCUIT SHUTOFF DEVICE

CROSS-REFERENCE TO RELATED APPLICATIONS

This is a Continuation Application of U.S. application Ser. No. 13/610,278 filed Sep. 11, 2012 which claims priority from Japanese Patent Application No. 2011-198108, filed Sep. 12, 2011. The entire disclosures of the prior applications are hereby incorporated by reference.

BACKGROUND OF THE INVENTION

1. Field of the Invention

The present invention relates to a power source circuit shutoff device for implementing connecting and disconnecting (shutoff) of a power source circuit by operating an operation lever.

2. Description of the Related Art

In order to secure operation safety for maintenance and the like of an electric system, a power source circuit shutoff device (service plug) capable of shutting off energization between a power source and a load is installed to an electric car or a hybrid car. As the power source circuit shutoff device, one having a structure in which operating an operation lever can mate and separate connector housings with and from each other with a small operational force is proposed (see Japanese Patent Unexamined Publication No. 2009-181895 (Patent Literature 1)). A conventional example of this type of power source circuit shutoff device is shown in FIG. 1 to FIG. 5.

In FIG. 1 to FIG. 5, a power source circuit shutoff device 100 is provided with a base housing 102 and a lever housing 120 which is mated with and separated from the base housing 102. The base housing 102 has a first mating wall 104 in a form of a frame. The inner portion of the first mating wall 104 is formed into a housing mating chamber 105. The upper face of the housing mating chamber 105 is open. A pair of first terminals (not shown) are disposed in the housing mating chamber 105. One of the pair of first terminals is connected to a battery while the other of the pair of first terminals is connected to a load. A pair of cam pins 107 are protrudingly provided on respective side faces of the first mating wall 104.

The lever housing 120 has a second mating wall 122. The second mating wall 122 has such a dimension that can be slidably mated with and separated from the housing mating chamber 105 in the first mating wall 104. A pair of second terminals (not shown) are protrudingly provided inside the second mating wall 122. The pair of second terminals are conductive with each other via, for example, a fuse.

Further, an operation lever 140 is supported to the lever housing 120 so as to be rotatable around a support shaft 124. The operation lever 140 rotates between a vertical position (positions in FIG. 2 and FIG. 3A) and a horizontal position (positions in FIG. 1 and FIG. 4). The operation lever 140 is provided with a pair of cam grooves 143 in positions bilaterally symmetrical. Each cam groove 143 has such a configuration that the distance from the support shaft 124 to the cam groove 143 becomes gradually shorter from an inlet portion 143*a* toward an inner side of the cam groove 143.

In the above structure, the power source conduction operation of the power source circuit shutoff device 100 will be explained. As shown in FIG. 2, the operation lever 140 is set in a position perpendicular to the lever housing 120. And the second mating wall 122 of the lever housing 120 is aligned with the housing mating chamber 105 of the base housing 102. As shown in FIG. 3A, the second mating wall 122 of the lever housing 120 is inserted into the housing mating chamber 105 of the base housing 102. Then, the second mating wall 122 is inserted to a position where the cam pin 107 is inserted into the inlet portion 143*a* of the cam groove 143 of the operation lever 140. This sets the base housing 102 and the lever housing 120 in a lever mating start position. In the lever mating start position, the first mating wall 104 and the second mating wall 122 are brought into a partly overlapping state.

Next, the operation lever 140 is rotated to the horizontal position (in the direction of an arrow L in FIG. 3). Then, the cam pin 107 moves within the cam groove 143 and a mating force is operated between the base housing 102 and the lever housing 120 to thereby mate the second mating wall 122 gradually deeper into the housing mating chamber 105.

As shown in FIG. 1 and FIG. 4, when the operation lever 140 is rotated to the horizontal position, the first mating wall 104 and the second mating wall 122 are brought into a lever mating completion state. The terminals (not shown) of the base housing 102 and the terminals (not shown) of the lever housing 120 start contacting each other in the mating midway position and are brought into a proper contact state in the lever mating completion position. The power source circuit is brought into a conduction state.

Further, the power source shutoff operation of the power source circuit shutoff device 100 is implemented by reversely operating the operation lever 140. That is, the operation lever 140 in the horizontal position is reversely rotated to the vertical position. Then, the cam pin 107 moves within the cam groove 143, and a separating force is operated between the base housing 102 and the lever housing 120 to thereby move the second mating wall 122 gradually in a direction separated from the housing mating chamber 105. The terminals (not shown) of the base housing 102 and the terminals (not shown) of the lever housing 120 stop contacting each other from the mating midway position and are brought into a non-contact state with the lever 140 in the vertical position. The power source circuit is brought into a non-conduction state.

SUMMARY OF THE INVENTION

With the conventional power source circuit shutoff device 100, however, a problem arises that, in the power source conduction operation, at the time of starting operation of the operation lever 140 the lever housing 120 is inclined relative to the base housing 102, thus deteriorating operability of the operation lever 140.

That is, substantially an entire circumference of each of an inner peripheral face of the first mating wall 104 and an outer peripheral face of the second mating wall 122 is defined as a mating guide face (see FIG. 3B). Therefore, it is indispensable to provide a clearance between the first mating wall 104 and the second mating wall 122 in order to accomplish smooth mating and separating. Further, in a lever operation start portion (position in FIG. 3B), the overlapping dimension of the first mating wall 104 and the second mating wall 122 (overlap amount) is smaller than the overlapping dimension (overlap amount) in other positions. Thus, when the operation lever 140 is rotated from the vertical position to the horizontal position side (direction L), the rotational force inclines the lever housing 120 in the rotational direction L. When the lever housing 120 is inclined, a sliding resistance between the second mating wall 122 and the first mating wall 104 is greatly increased, thus preventing a smooth mating movement. By this, the operational force of the operation lever 140 is increased, resulting in deteriorated operability.

Patent Literature 1 discloses a structure in which a boss is protrudingly provided at a second mating wall of a lever housing and a groove is disposed at a first mating wall of a base housing corresponding to the second mating wall. The above structure can prevent, as much as possible, an oscillation in a rotational direction (equivalent to a rotational direction R in FIG. 5B) along a face perpendicular to the mating direction of the lever housing (equivalent to the plane of paper direction in FIG. 5). However, inclination of the lever housing at the time of starting operation of the operation lever cannot be prevented.

The present invention has been made to solve the above problem. It is therefore an object of the present invention to provide a power source circuit shutoff device having a good operability of an operation lever.

According to a first aspect of the present invention, there is provided a power source circuit shutoff device including: a base housing including a first mating wall having a first terminal disposed therein, and a cam pin; a lever housing including a second mating wall having a second terminal disposed therein; and an operation lever rotatably supported to the lever housing and having a cam groove for guiding the cam pin, in which the base housing and the lever housing are set in a lever mating start position in which the first mating wall and the second mating wall are partly overlapped with each other and the cam pin is entered into the cam groove of the operation lever, and a rotation of the operation lever moves the cam pin in the cam groove to thereby cause a mating force between the first mating wall and the second mating wall, thereby proceeding a mating between the first mating wall and the second mating wall, and the first terminal and the second terminal are electrically connected in a lever mating completion position, and in which the base housing and the lever housing respectively have restriction ribs configured to be engaged with each other between the lever mating start position and the lever mating completion position to thereby guide the mating and separating between the first mating wall and the second mating wall, and configured to restrict an inclination of the operation lever in a rotational direction.

The restriction ribs of the respective base housing and lever housing may restrict an inclination of the lever housing in a rotational direction along a face perpendicular to a mating direction of the lever housing.

The restriction rib of the base housing may be disposed on an inner side of the first mating wall and the restriction rib of the lever housing may be disposed at a position corresponding to the restriction rib of the base housing.

The base housing has a pair of restriction ribs which are provided on both sides of an axis as a rotational axis of the operation lever and are provided at diagonal positions with a center of the axis as a point of symmetry, and the lever housing has a pair of restriction ribs which are provided on the both sides of the axis as the rotational axis of the operation lever and are provided at the diagonal positions with the center of the axis as the point of symmetry.

According to the first aspect of the present invention, when the base housing and lever housing are set in the lever mating start position, and the operation lever is rotated, a rotational force is exerted to incline the lever housing relative to the base housing. However, the interference between the restriction rib of the base housing and the restriction rib of the lever housing restricts the inclination of the lever housing. This prevents, as much as possible, the lever housing from being inclined relative to the base housing and allows the lever housing to move in the mating direction by a smooth sliding operation. Thus, a good operability of the operation lever is accomplished.

BRIEF DESCRIPTION OF THE DRAWINGS

FIG. 3A is a front view of the power source circuit shutoff device in a lever mating start position and FIG. 3B is a schematic cross sectional view of an essential part taken along the line 3B-3B in FIG. 3A.

FIG. 5 shows the conventional example, where

FIG. 8A is a front view of the power source circuit shutoff device in a lever mating start position and FIG. 8B is a schematic cross sectional view of an essential part taken along the line 8B-8B in FIG. 8A.

FIG. 10A is a bottom view of the lever housing and FIG. 10B is a plan view of the base housing.

DESCRIPTION OF EMBODIMENTS

Figure 1:
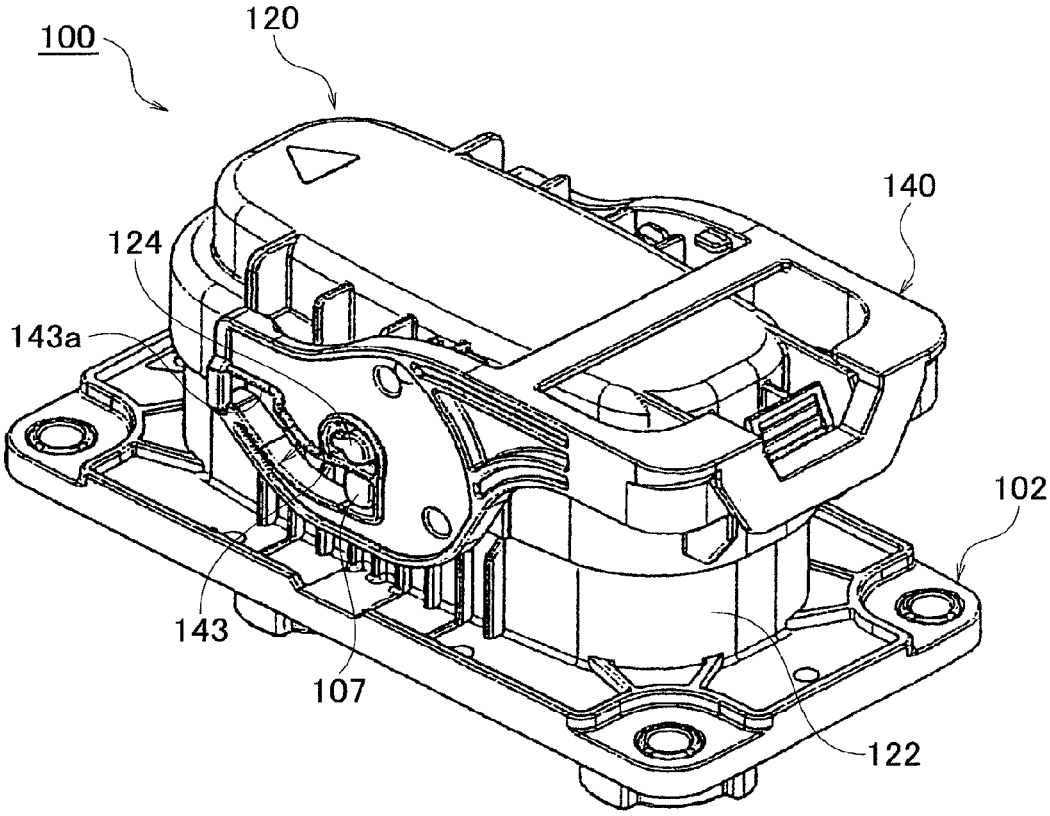
FIG. 1 Prior Art
FIG. 1 shows a conventional example, and is a perspective view of a power source circuit shutoff device in a lever mating completion position.
Figure 2:
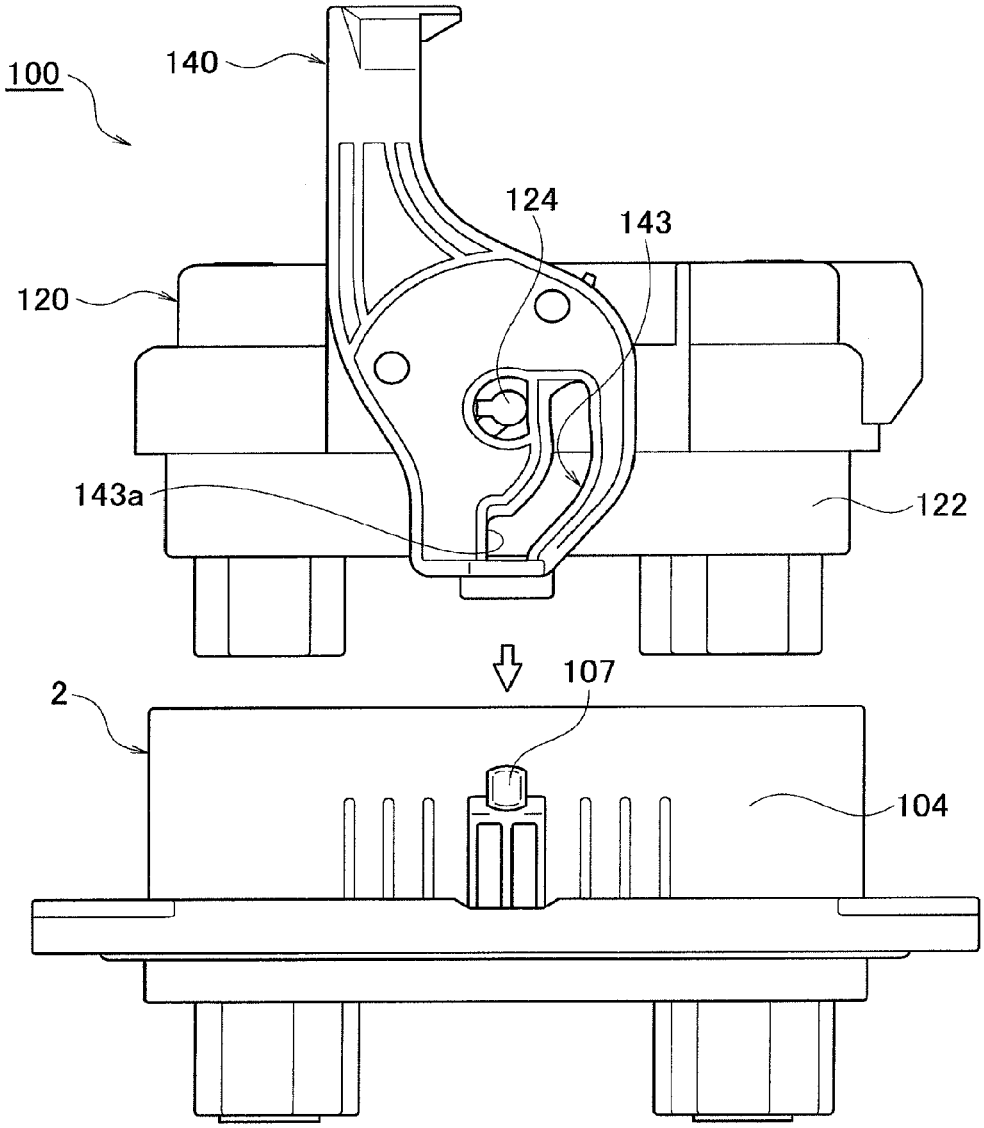
FIG. 2 Prior Art
FIG. 2 shows the conventional example, and is a front view of the power source circuit shutoff device with a lever housing in a completely separated position relative to a base housing.
Figure 3A:
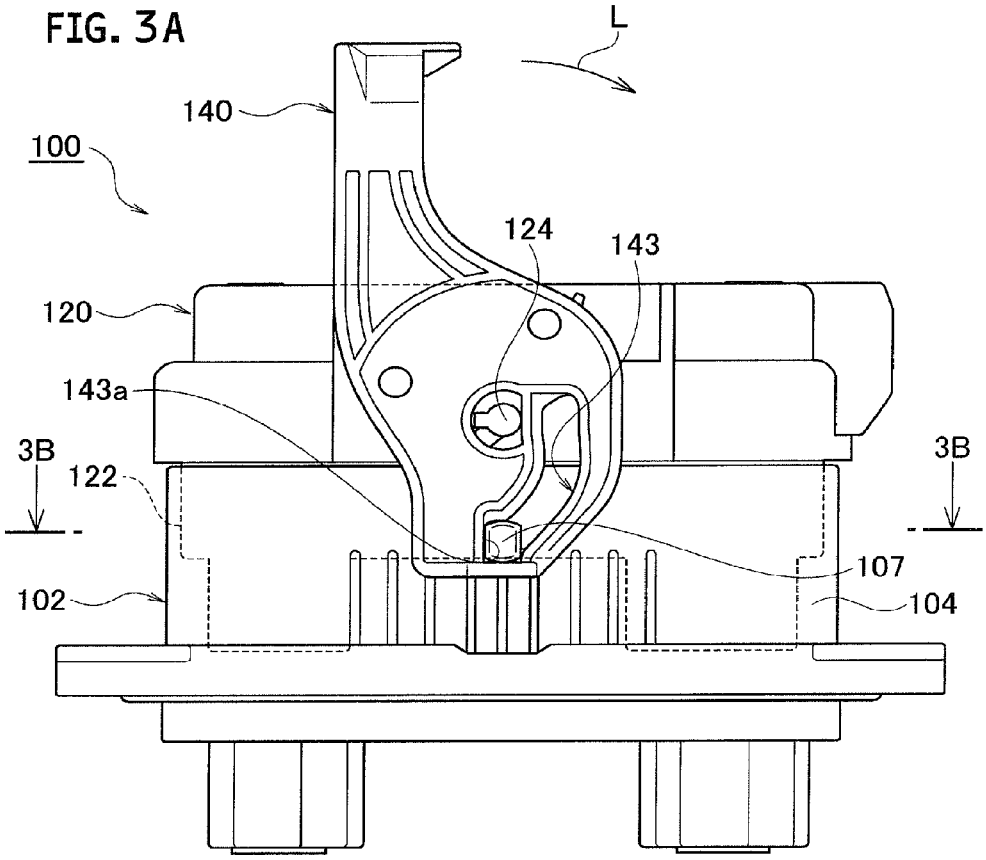
Prior Art FIG. 3A
FIGS. 3A and 3B show the conventional example, where
Figure 3B:
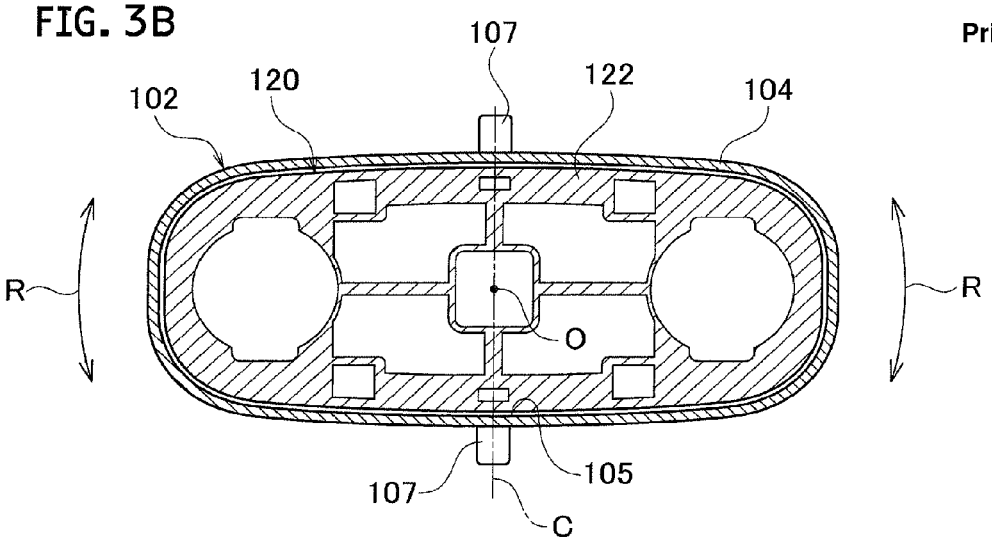
FIG. 3B Prior Art
Figure 4:
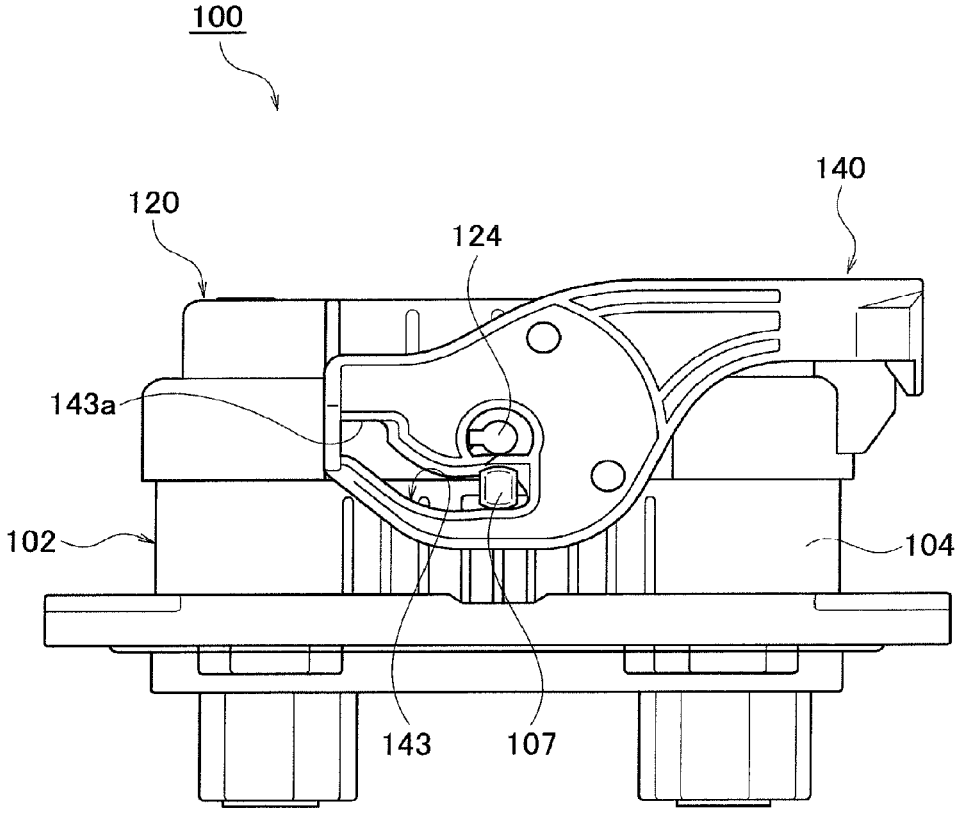
FIG. 4 Prior Art
FIG. 4 shows the conventional example, and is a front view of the power source circuit shutoff device in a lever mating completion position.
Figure 5A:
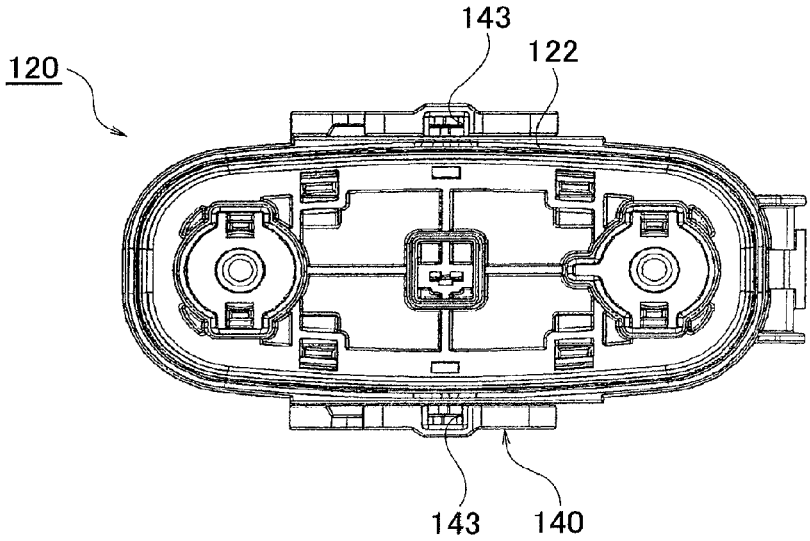
FIG.5A Prior Art
FIG. 5A is a bottom view of the lever housing and FIG. 5B is a plan view of the base housing.
Figure 5B:
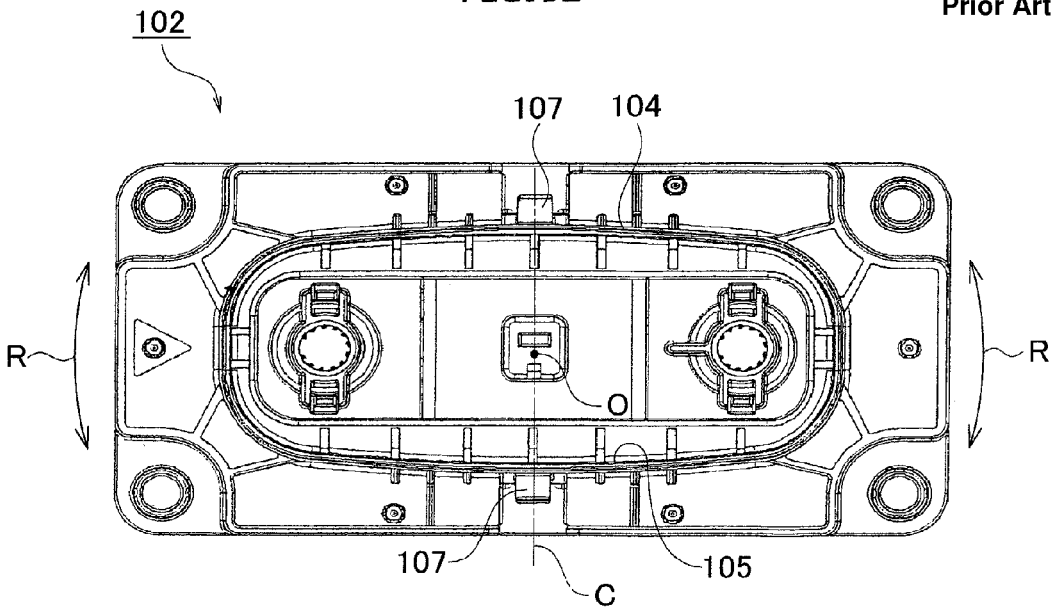
FIG.5B Prior Art

Hereinafter, one embodiment of the present invention will be explained based on drawings.

FIG. 6 to FIGS. 10A, 10B show one embodiment of the present invention. In FIG. 6 to FIGS. 10A, 10B, a power source circuit shutoff device 1 is provided with a base housing 2 and a lever housing 20 which is configured to be mated with and separated from the base housing 2.

The base housing 2 has a mounting bracket portion 3 and a first mating wall 4 which is in a form of a frame and protruding upward from a center of the mounting bracket portion 3. Utilizing the mounting bracket portion 3, the base housing 2 is fixed to a vehicular body. A housing mating chamber 5 is formed inside the first mating wall 4. The upper face of the housing mating chamber 5 is open. A pair of terminal supporting walls 6 are protrudingly provided in the housing mating chamber 5. A pair of first terminals (not shown) are disposed in the pair of terminal supporting walls 6. The pair of first terminals (not shown) are, for example, female terminals. One of the pair of first terminals is connected to a battery while the other of the pair of first terminals is connected to a load.

A pair of cam pins 7 are protrudingly provided on outer faces at both sides of the first mating wall 4.

Figure 8A:
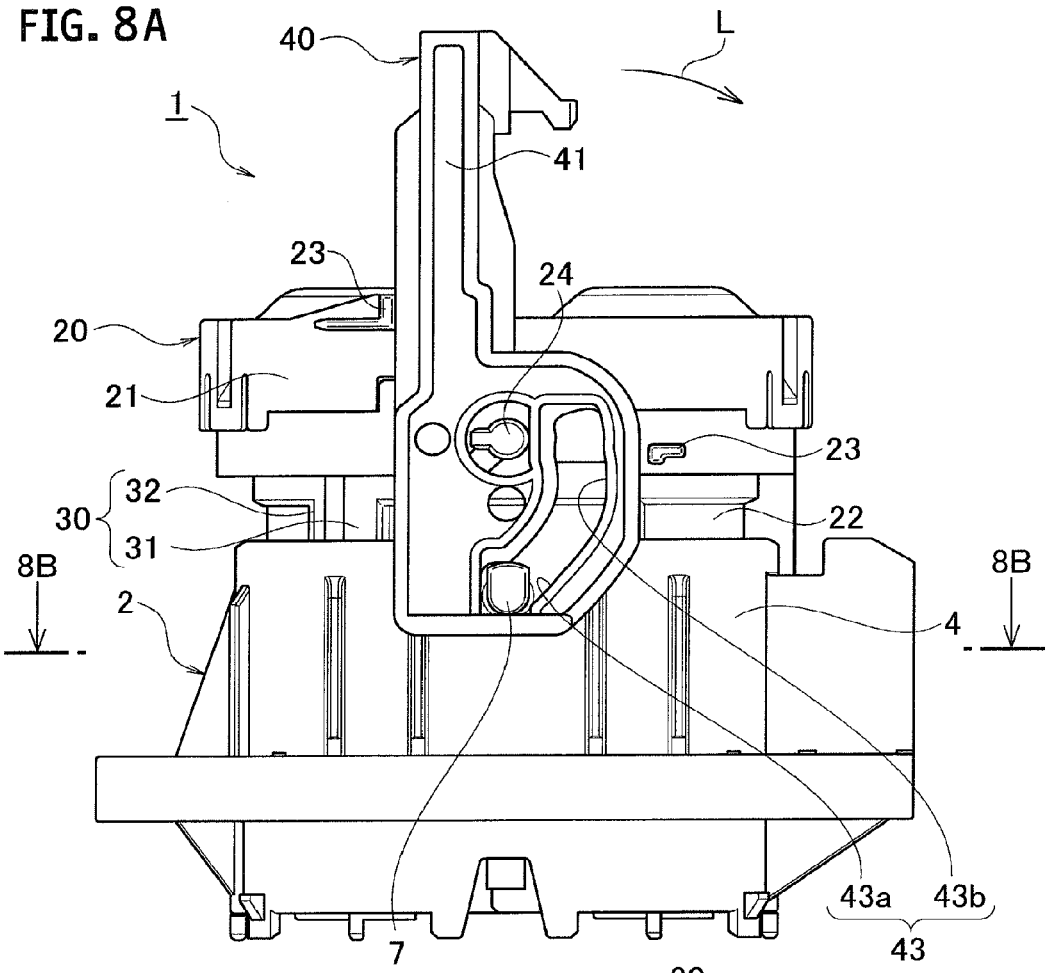
FIGS. 8A and 8B show the embodiment of the present invention, where
Figure 8B:
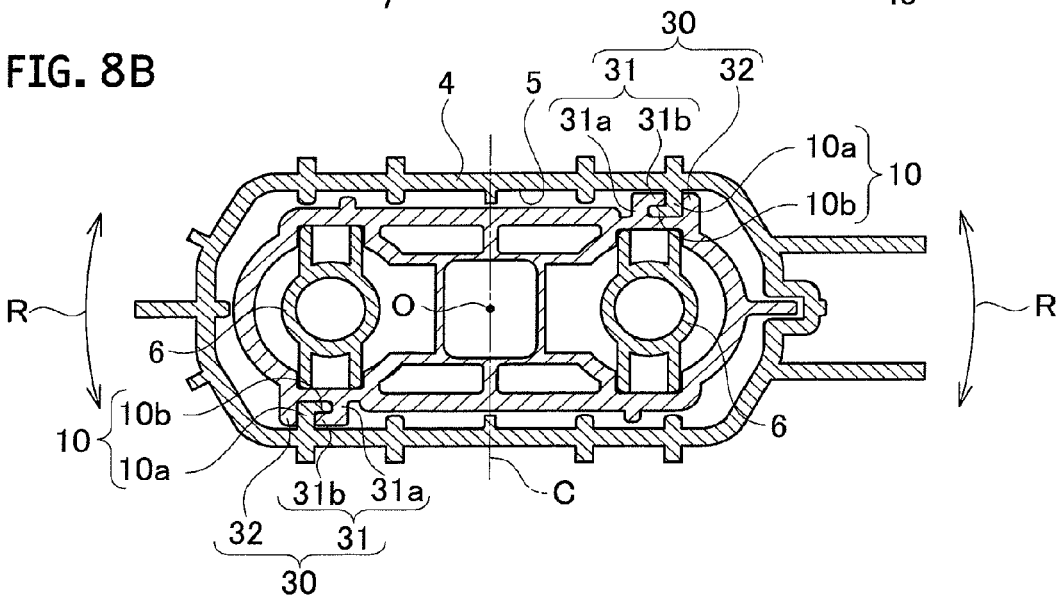
Figure 10A:
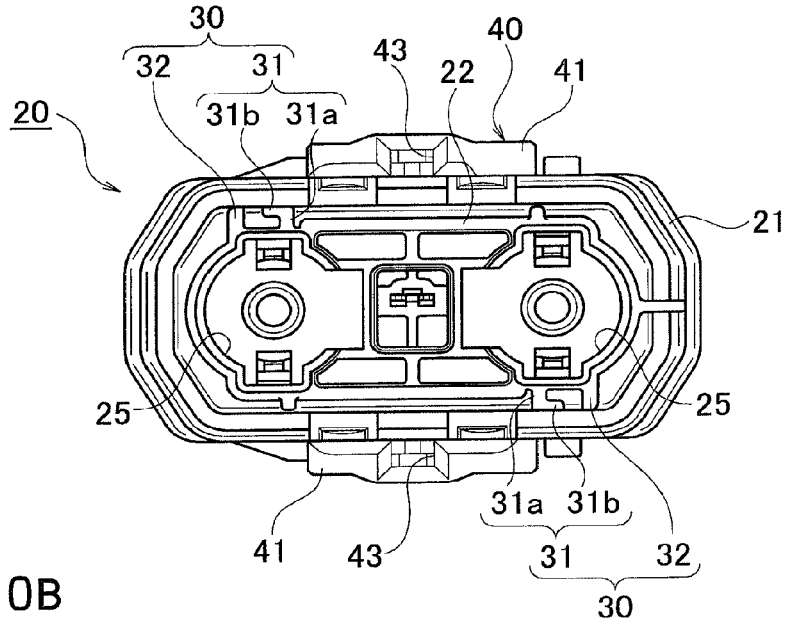
FIGS. 10A and 10B show the embodiment of the present invention, where
Figure 10B:
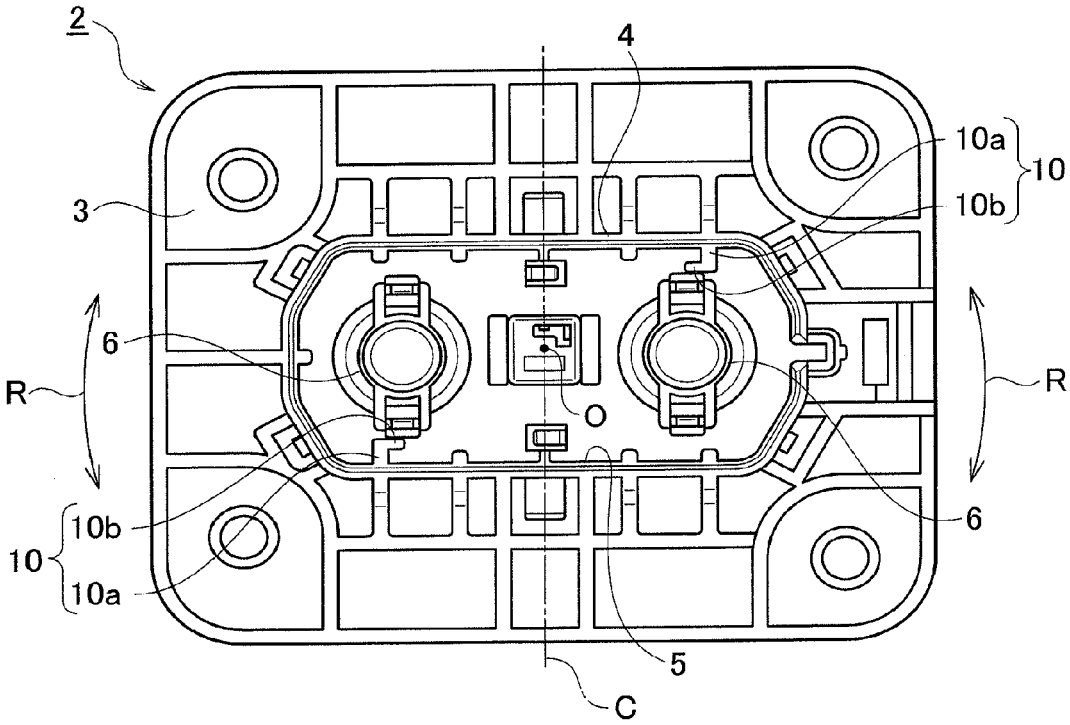

As shown in detail in FIG. 8B and FIG. 10B, a pair of base side restriction ribs 10 are protrudingly provided on an inner face of the first mating wall 4 in substantially the entire area in the vertical direction. The pair of base side restriction ribs 10 are disposed immediately outside the pair of terminal supporting walls 6. The pair of base side restriction ribs 10 are provided on both side regions sandwiching therebetween an axis C (hereinafter, center axis C) as a rotational center of the operation lever 40 and provided in diagonal positions with a center O of the center axis C as a point of symmetry. Each of the base side restriction ribs 10 is formed with a straight wall portion 10*a* extending from the inner face of the first mating wall 4 parallel to the center axis C of the operation lever 40 and a bent wall portion 10*b* bent in a direction perpendicular to the center axis C of the operation lever 40 on a distal end side of the straight wall portion 10*a*. That is, the base side restriction rib 10 is formed into an alphabetical L (hook-like shape). The pair of bent wall portions 10*b* are bent toward the center axis C of the operation lever 40 respectively.

The lever housing 20 has an upper wall portion 21 and a second mating wall 22 provided to protrude downward from the upper wall portion 21. The upper wall portion 21 has a scale slightly larger than the second mating wall 22. On outer faces at both sides of the upper wall portion 21, lever over-rotation preventing protrusions 23 are protrudingly provided at two positions. The lever over-rotation preventing protrusion 23 restricts the rotational area of the operation lever 40, as described below. A pair of support shafts 24 are disposed on the outer faces at both sides of the upper wall portion 21. The second mating wall 22 has such a dimension that the second mating wall 22 can be slidably mated with and separated from the housing mating chamber 5 in the first mating wall 4. A pair of terminal receiving chambers 25 are provided in the second mating wall 22. A pair of second terminals (not shown) are disposed in the pair of terminal receiving chambers 25. The pair of second terminals (not shown) are, for example, male terminals. The second terminals are conductive with each other via, for example, a fuse.

As shown in detail in FIG. 8A and FIG. 10A, a pair of lever side restriction ribs 30 are protrudingly provided on an inner face of the second mating wall 22 in substantially the entire area in the vertical direction. The pair of lever side restriction ribs 30 are disposed at the terminal receiving chamber 25. The pair of lever side restriction ribs 30 are disposed at positions respectively corresponding to the pair of base side restriction ribs 10. That is, the pair of lever side restriction ribs 30 are provided on both side regions sandwiching therebetween the axis C (center axis C) as the rotational center of the operation lever 40 and provided at diagonal positions with the center O of the center axis C as the point of symmetry. Each lever side restriction rib 30 includes a first restriction rib 31 and a second restriction rib 32 which are disposed at an interval. The first restriction rib 31 has a straight wall portion 31*a* extending from the inner face of the second mating wall 22 parallel to the center axis C of the operation lever 40 and a bent wall portion 31*b* bent in a direction perpendicular to the center axis C of the operation lever 40 at a distal end side of the straight wall portion 31*a*. That is, the first restriction rib 31 is formed into an alphabetical L (hook-like shape). Contrary to the bent wall portions 10*b* of the base side restriction rib 10, the bent wall portions 31*b* are respectively bent in a direction away from the center axis C of the operation lever 40. The second restriction rib 32 is disposed at an interval relative to the first restriction rib 31 such that the base side restriction rib 10 is sandwiched between the first restriction rib 31 and the second restriction rib 32. The second restriction rib 32 is in a straight form extending from the inner face of the second mating wall 22 parallel to the center axis C of the operation lever 40.

The lever side restriction rib 30 and the above described base side restriction rib 10 engage with each other between the lever mating start position and the lever mating completion position, to thereby guide the mating and separating between the first mating wall 4 and the second mating wall 22.

The operation lever 40 is rotatably supported to the pair of support shafts 24. The operation lever 40 rotates between the vertical position (positions in FIG. 7 and FIG. 8A) and the horizontal position (positions in FIG. 6 and FIG. 9). The operation lever 40 is provided with a pair of arm plate portions 41 and an operation pinching portion 42 for connecting the pair of arm plate portions 41 on a rotation distal end side. Each of the pair of arm plate portions 41 is supported to one of the pair of respective support shafts 24. Each of the pair of arm plate portions 41 is formed with one of a pair of cam grooves 43. Each of the pair of cam pins 7 of the base housing 2 is inserted into one of the pair of cam grooves 43.

The cam groove 43 has an inlet portion 43*a* into which the cam pin 7 is entered from outside and a curved portion 43*b* which communicates with the inlet portion 43*a* and has a distance from the center of the support shaft 24 gradually changed.

With the cam pin 7 moving within the cam groove 43, the operation lever 40 rotates between the vertical position and the horizontal position. With the operation lever 40 in the vertical position, the cam pin 7 can enter into the inlet portion 43*a* or get out of the inlet portion 43*a*. With the operation lever 40 in the horizontal position, the cam pin 7 is located in the innermost position of the curved portion 43*b*. That is, in the rotation process of the operation lever 40 between the vertical position and the horizontal position, the cam pin 7 moves in the curved portion 43*b*, causing a mating force or a separating force between the base housing 2 and the lever housing 20, thereby moving the first mating wall 4 and the second mating wall 22 in the mating direction or the separating direction.

Figure 7:
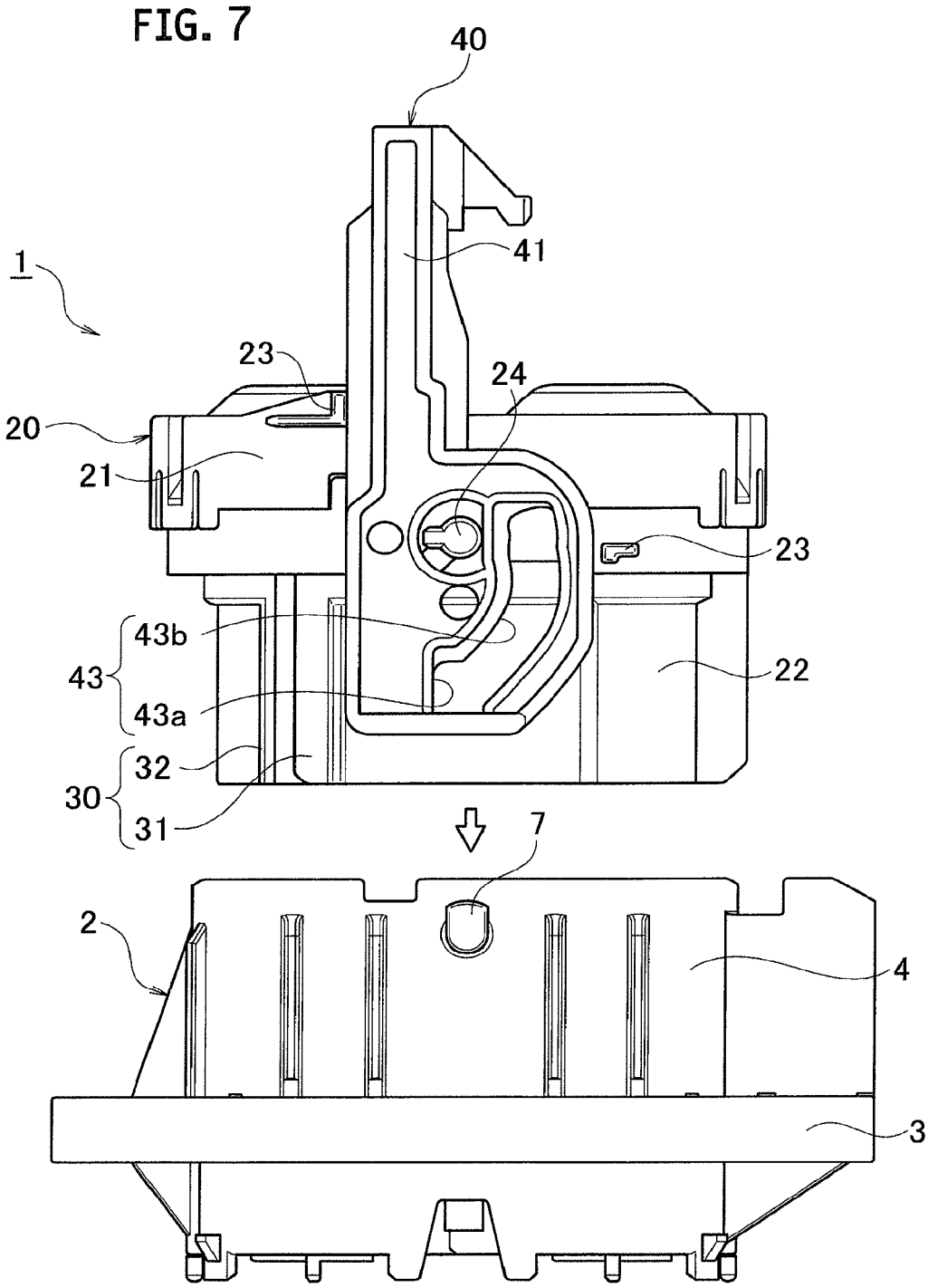
FIG. 7 shows the embodiment of the present invention, and is a front view of the power source circuit shutoff device with a lever housing in a completely separated position relative to a base housing.

In the above structure, the power source conduction operation of the power source circuit shutoff device 1 will be explained. As shown in FIG. 7, with the operation lever 40 set in the vertical position relative to the lever housing 20, the second mating wall 22 of the lever housing 20 is aligned with the housing mating chamber 5 of the base housing 2.

Then, as shown in FIG. 8A, the second mating wall 22 of the lever housing 20 is inserted into the housing mating chamber 5 of the base housing 2. Then, the second mating wall 22 is inserted to such a position that the cam pin 7 is inserted to the inlet portion 43*a* of the cam groove 43 of the operation lever 40. This sets the base housing 2 and the lever housing 20 at the lever mating start position. At the lever mating start position, the first mating wall 4 and the second mating wall 22 are partly overlapped with each other. Further, in the lever mating start position, as shown in FIG. 8B, the base side restriction rib 10 and the lever side restriction rib 30 engage with each other. Specifically, in the direction perpendicular to the center axis C of the operation lever 40, the base side restriction ribs 10 is sandwiched between the first restriction rib 31 and second restriction rib 32 of the lever side restriction rib 30. In the direction of the center axis C of the operation lever 40, the bent wall portion 10*b* of the base side restriction rib 10 abuts the bent wall portion 31*b* of the first restriction rib 31 of the lever side restriction rib 30.

Next, the operation lever 40 in the vertical position is rotated toward the horizontal position (direction of arrow L). Then, the cam pin 7 moves in the cam groove 43, causing a mating force between the base housing 2 and the lever housing 20, to thereby move the first mating wall 4 and second mating wall 22 in the mating direction. This movement is implemented while being guided by the base side restriction rib 10 and lever side restriction rib 30. This movement allows the second mating wall 22 to enter gradually deeper into the housing mating chamber 5.

Figure 6:
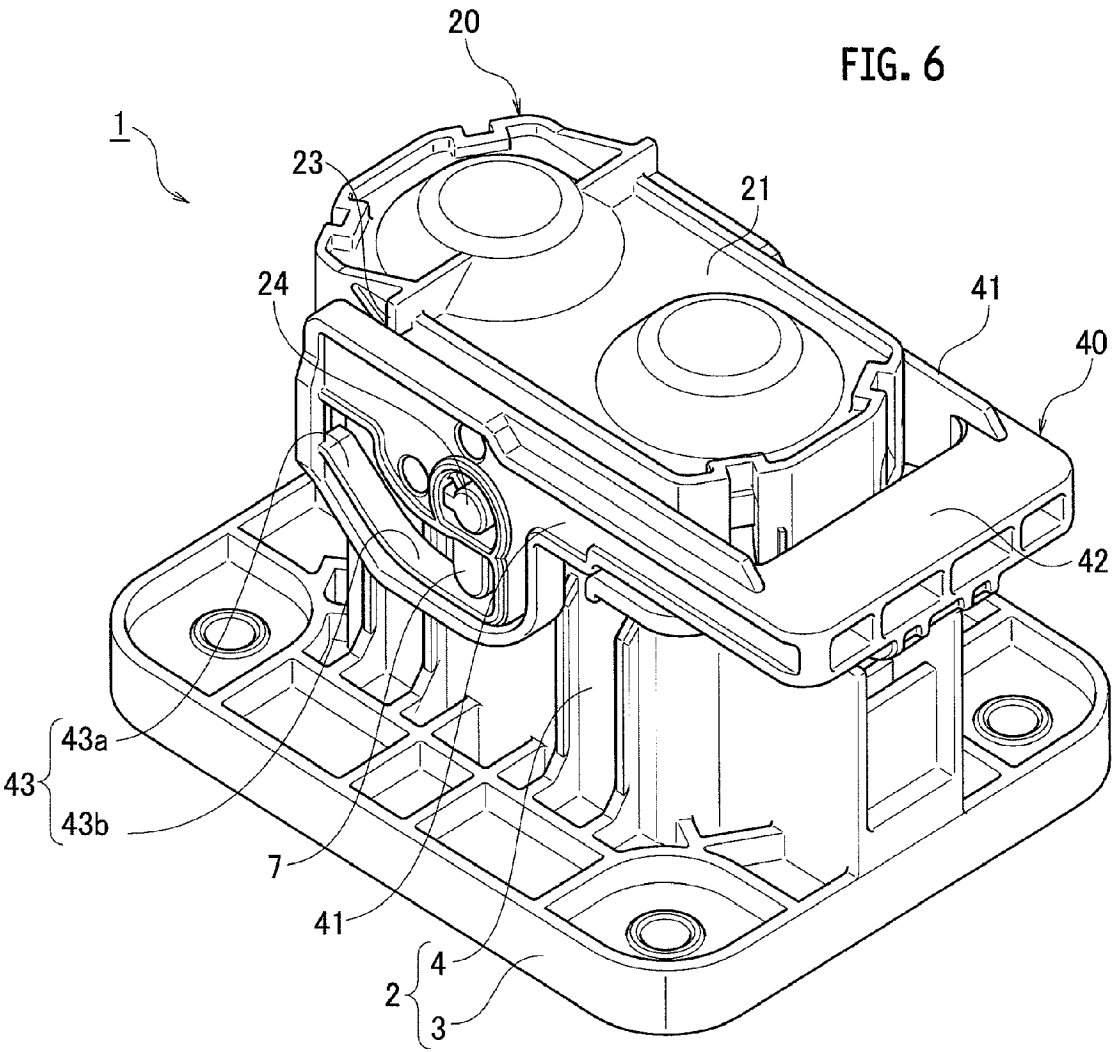
FIG. 6 shows one embodiment of the present invention, and is a perspective view of a power source circuit shutoff device in a lever mating completion position.
Figure 9:
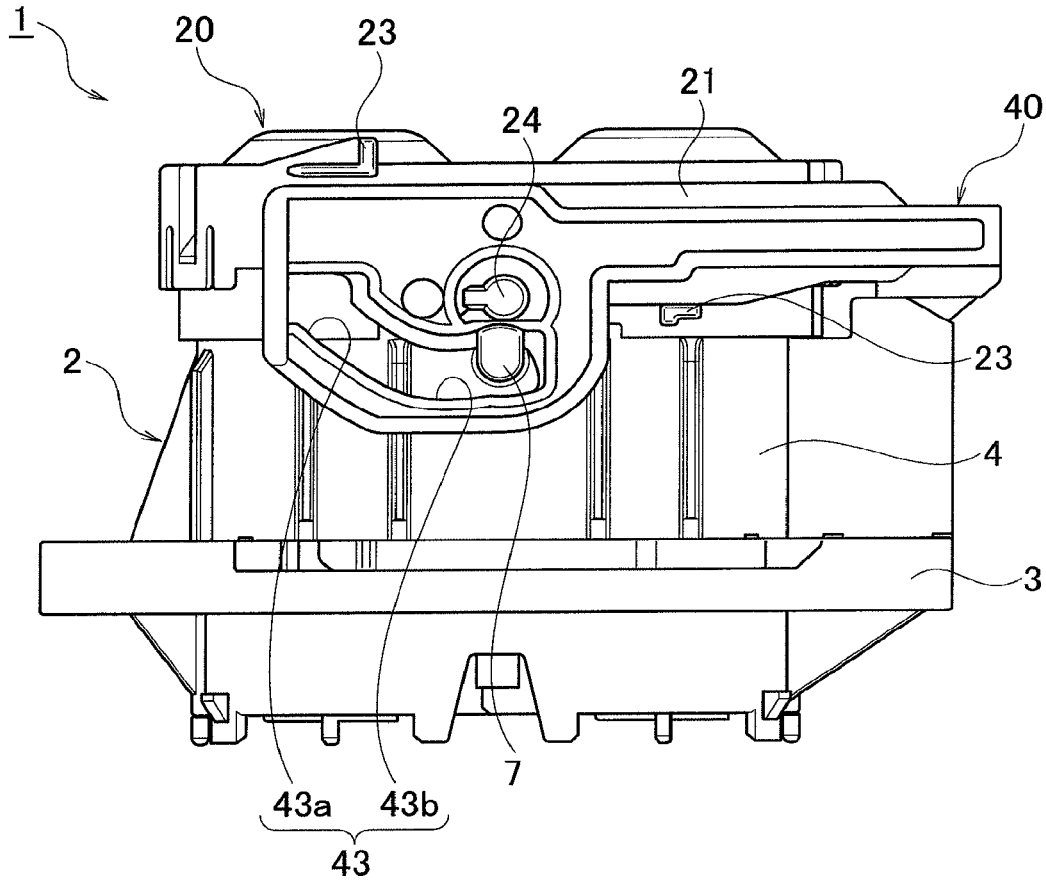
FIG. 9 shows the embodiment of the present invention, and is a front view of the power source circuit shutoff device in the lever mating completion position.

As shown in FIG. 6 and FIG. 9, when the operation lever 40 rotates to the horizontal position, the first mating wall 4 and the second mating wall 22 are brought into a lever mating completion state. The terminal (not shown) of the base housing 2 and the terminal (not shown) of the lever housing start contacting each other from the mating midway position and are brought into a proper contact state in the lever mating completion position. The power source circuit is brought into a conduction state.

Further, the power source shutoff operation of the power source circuit shutoff device 1 is implemented by reversely operating the operation lever 40 in the horizontal position. That is, the operation lever 40 in the horizontal position is reversely rotated toward the vertical position. Then, the cam pin 7 moves in the cam groove 43, causing a separating force between the base housing 2 and the lever housing 20, to thereby move the second mating wall 22 gradually in the separating direction away from the housing mating chamber 5. This movement is also implemented while being guided by the base side restriction rib 10 and lever side restriction rib 30. The terminal (not shown) of the base housing 2 and the terminal (not shown) of the lever housing 20 stop contacting each other from the mating midway position and are brought into a non-contact state in the vertical position. The power source circuit is brought into a non-conduction state.

As explained above, with the power source circuit shutoff device 1, the base housing 2 and the lever housing 20 are respectively provided with the base side restriction rib 10 and the lever side restriction rib 30 which are engaged with each other from the lever mating start position to the lever mating completion position and thereby guide the mating and separating between the first mating wall 4 and the second mating wall 22. Thus, the smooth mating and separating of the first mating wall 4 and second mating wall 22 can be accomplished.

Further, in the above-described power source conduction operation process, as shown in FIG. 8A, the rotational force is applied to the lever housing 20 so as to incline the lever housing 20 relative to the base housing 2 in the rotational direction L of the operation lever 40 at the time of starting rotation of the operation lever 40. However, the base side restriction rib 10 of the base housing 2 and the lever side restriction rib 30 of the lever housing 20 restrict the rotational force which is likely to incline the lever housing 20. Specifically, inclination of the lever housing 20 is restricted by the straight wall portion 10*a* of the base side restriction rib 10, and the straight wall portion 31*a* (of the first restriction rib 31) and second restriction rib 32 of the lever side restriction rib 30. By this, the lever housing 20 hardly is inclined relative to the base housing 2 in the rotational direction L of the operation lever 40, thus allowing the lever housing 20 to move in the mating direction by a smooth sliding operation. Thus, a good operability of the operation lever 40 is accomplished.

Further, the base side restriction rib 10 and lever side restriction rib 30, as described above, function as movement guides of the first mating wall 4 and second mating wall 22 respectively and also as positioners of the first mating wall 4 and second mating wall 22 respectively.

The interference between the bent wall portion 10*b* of the base side restriction rib 10 and the bent wall portion 31*b* of the first restriction rib 31 of the lever side restriction rib 30 restrict the movement of the lever housing 20 in the rotational direction R along the face perpendicular to the mating direction of the lever housing 20 (equivalent to the plane of paper direction in FIG. 8B). Thus, an oscillation of the lever housing 20 in the rotational direction R can be prevented as much as possible.

The base side restriction rib 10 is provided inside the first mating wall 4 while the lever side restriction rib 30 is provided in the position corresponding to the base side restriction rib 10. Thus, the base side restriction rib 10 and lever side restriction rib 30 are respectively disposed near the center positions of the base housing 2 and lever housing 20, thereby making it possible to lessen the stress applied to the base side restriction rib 10 and lever side restriction rib 30.

A pair of the base side restriction ribs 10 are provided on both side regions sandwiching therebetween the axis C (center axis C) as the rotational center of the operation lever 40 and provided at diagonal positions with the center O of the center axis C as the point of symmetry; likewise, a pair of the lever side restriction ribs 30 are provided on both side regions sandwiching therebetween the axis C (center axis C) as the rotational center of the operation lever 40 and provided at diagonal positions with the center O of the center axis C as the point of symmetry. Thus, the inclination of the lever housing 20 (inclination in the rotational direction L) by the rotation of the operation lever 40 and the oscillation of the lever housing 20 in the rotational direction R can be stably restricted with balance between right and left.

What is claimed is:

1. A power source circuit shutoff device comprising:

a base housing including:

a first mating wall having a first terminal disposed therein, and a cam pin;

a lever housing including:

a second mating wall having a second terminal disposed therein; and an operation lever rotatably supported to the lever housing and having a cam groove for guiding the cam pin, wherein:

the base housing and the lever housing are set in a lever mating start position in which the first mating wall and the second mating wall are partly overlapped with each other and the cam pin is entered into the cam groove of the operation lever, and a rotation of the operation lever moves the cam pin in the cam groove to thereby cause a mating force between the first mating wall and the second mating wall, thereby proceeding a mating between the first mating wall and the second mating wall, and the first terminal and the second terminal are electrically connected in a lever mating completion position, the base housing and the lever housing respectively have restriction ribs configured to be engaged with each other between the lever mating start position and the lever mating completion position to thereby guide the mating and separating between the first mating wall and the second mating wall, and configured to restrict an inclination of the operation lever in a rotational direction, and each of the restrictions ribs has a complementary L-shape configured to be engaged with each other.

2. The power source circuit shutoff device according to claim 1, wherein the restriction ribs of the respective base housing and lever housing restrict an inclination of the lever housing in a rotational direction along a face perpendicular to a mating direction of the lever housing.

3. The power source circuit shutoff device according to claim 1, wherein the restriction rib of the base housing is disposed on an inner side of the first mating wall and the restriction rib of the lever housing is disposed at a position corresponding to the restriction rib of the base housing.

4. The power source circuit shutoff device according to claim 1, wherein the base housing has a pair of restriction ribs which are provided on both sides of an axis as a rotational axis of the operation lever and are provided at diagonal positions with a center of the axis as a point of symmetry, and the lever housing has a pair of restriction ribs which are provided on the both sides of the axis as the rotational axis of the operation lever and are provided at the diagonal positions with the center of the axis as the point of symmetry.

5. The power source circuit shutoff device according to claim 1, wherein the restriction ribs are disposed at diagonally opposite sides of each of the base housing and the lever housing between the first mating wall and the second mating wall.

* * * * *